United States Patent [19]

Custer et al.

[11] 4,087,343

[45] May 2, 1978

[54] FLEXIBLE COVER OF A PLATY-FILLED COMPOSITION FOR AN ELECTROLYTIC CELL

[75] Inventors: Harry Samuel Custer, Barberton; Robert Charles Schisler, Akron, both of Ohio

[73] Assignee: The Goodyear Tire & Rubber Company, Akron, Ohio

[21] Appl. No.: 771,225

[22] Filed: Feb. 23, 1977

[51] Int. Cl.[2] ..... C25D 17/00; C25B 9/00

[52] U.S. Cl. ..... 204/219; 204/250; 204/279

[58] Field of Search ..... 204/279, 219–220, 204/250, 99

[56] References Cited

U.S. PATENT DOCUMENTS

| | | | |
|---|---|---|---|
| 2,998,374 | 8/1961 | Granfors | 204/250 |
| 3,450,621 | 6/1969 | Anderson | 204/279 X |
| 3,576,726 | 4/1971 | Cooper | 204/279 X |
| 3,794,577 | 2/1974 | Oliver et al. | 204/250 X |
| 3,968,022 | 7/1976 | Eng et al. | 204/279 |

*Primary Examiner*—John H. Mack
*Assistant Examiner*—D. R. Valentine
*Attorney, Agent, or Firm*—R. P. Yaist

[57] ABSTRACT

A flexible elastomeric cover particularly for an electrolytic cell of the mercury type. The cover has at least one layer comprised of a corrosion resistant elastomeric composition including a vulcanized rubbery polymer to resist deleterious fluids and a multiplicity of small, non-porous, inert particles of a plate-like structure dispersed throughout the polymer to further resist the permeation and penetration of such fluids into the cover with the preponderance of the particles having an aspect ratio of at least 20:1 and being oriented in a direction generally parallel to a surface of the cover to provide a barrier to the migration of such deleterious fluids. The rubbery polymer is preferably polyisoprene and the plate-like or platy particles are preferably graphite or glass flakes.

22 Claims, 6 Drawing Figures

FIG.1
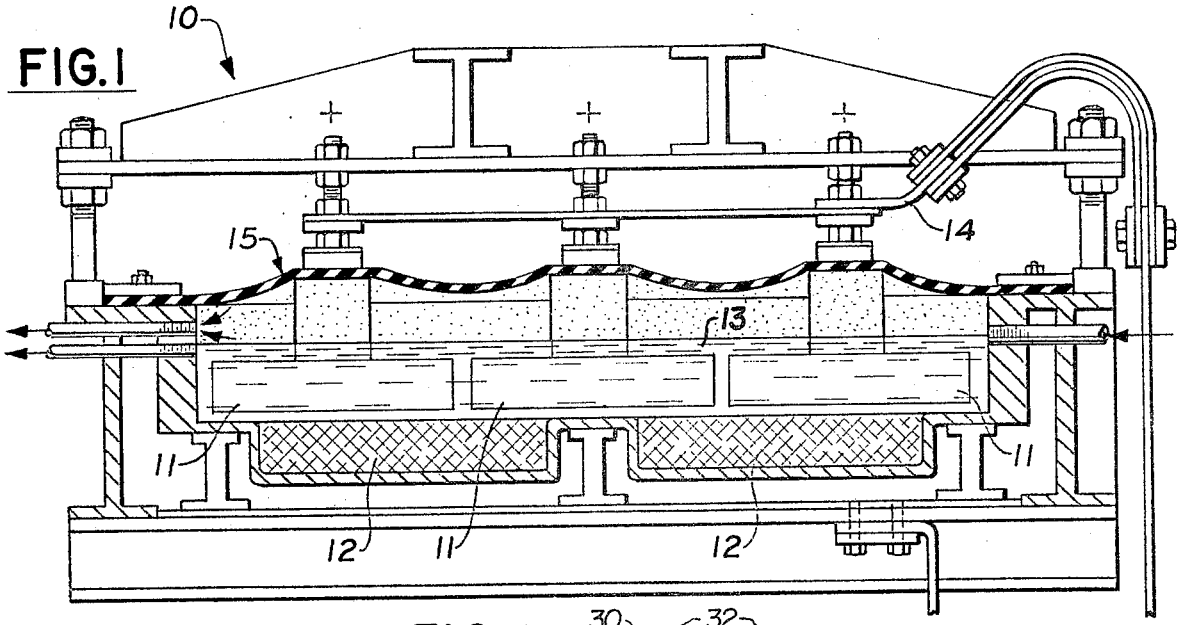
FIG.6
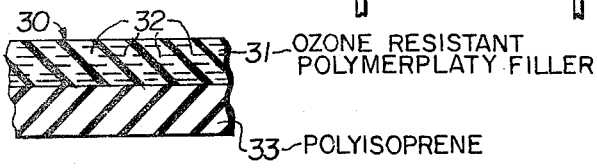
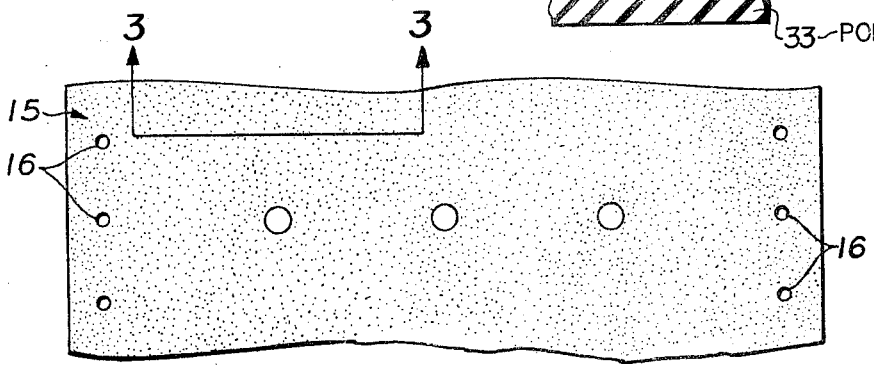
FIG. 2
FIG. 3
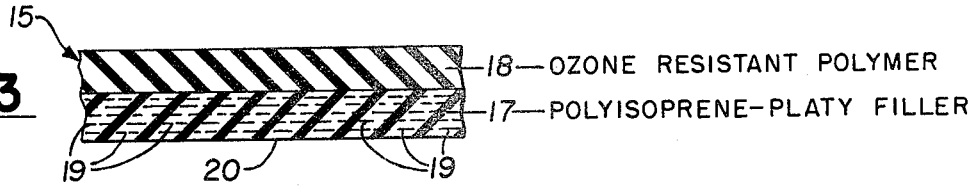
FIG. 4
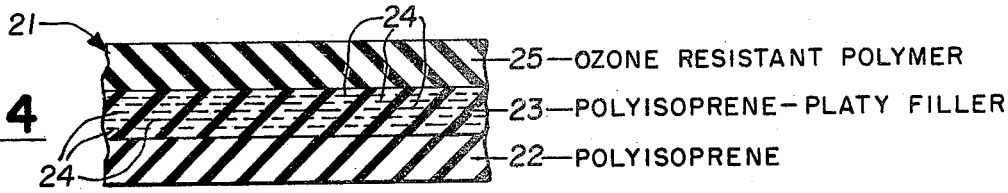
FIG. 5
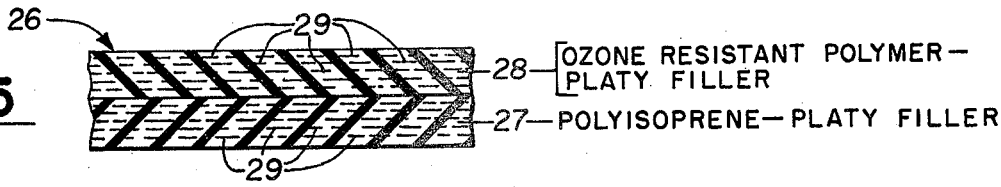

FLEXIBLE COVER OF A PLATY-FILLED COMPOSITION FOR AN ELECTROLYTIC CELL

BACKGROUND OF THE INVENTION

This invention relates to a flexible elastomeric cover for an electrolytic halide cell. More particularly, this invention relates to covers for mercury-type electrolytic chlorine cells having improved resistance to the permeation and penetration of deleterious fluids or gases.

Chlorine may be prepared by a continuous electrolytic process within an electrolytic cell, for example, of the mercury type as described in the *Encyclopedia of Chemical Technology,* Second Edition, Vol. 1, Pages 688–695 (1963). One such cell referred to as the DeNora cell is disclosed in U.S. Pat. No. 2,958,635 issued on Nov. 1, 1960 to V. DeNora. In this cell, graphite anodes and a liquid mercury cathode are suspended in a water solution of the metallic salt of chlorine such as sodium chloride after which a high current is passed through the brine or electrolyte solution. The ionized halogen migrates to the anode where two atoms combine to make a molecule which is discharged from the salt solution and recovered through a vacuum line. The free metal dissolves in the mercury cathode to form an amalgam which floats on the mercury and can therefore be withdrawn from the cell.

The free chlorine will normally contain a quantity of water from the brine which results in the formation of very corrosive substances in the hot gaseous chlorine atmosphere within the cell. Because very high electrical currents are necessary in the electrolytic process for producing chlorine, the atmosphere about the cell contains a high concentration of oxygen and ozone which especially when taken in combination, are extremely deleterious to most elastomeric compositions. Thus, electrolytic cell covers are subject to attack from both within and outside of the mercury cell.

Previously, these covers had been produced from laminates of elastomeric material with separate discernible layers integrally joined together during vulcanization. For example, one common laminate has been an inwardly facing layer of polyiosprene and an outwardly facing layer of neoprene rubber. In addition, U.S. Pat. No. 2,998,374 issued on Aug. 29, 1961 to P. G. Granfors discloses an elastomeric laminate having 3 layers or plies in which a layer of polyisoprene is sandwiched between inner and outer layers of neoprene rubber. It is also disclosed in this patent that chlorosulfonated polyethylene may be substituted for the neoprene and butyl rubber may be substituted for the polyisoprene. U.S. Pat. No. 3,450,621 issued on June 17, 1969 to R. F. Anderson discloses a laminated cover for a DeNora type cell characterized by an inner layer of natural rubber facing inwardly of the cell and an outer layer of ethylene propylene terpolymer material facing outwardly of the cell which may be bonded together by a tie gum layer of chlorinated butyl rubber disposed between the first named layers. These prior art constructions have not proven to be entirely satisfactory and have not successfully withstood the combined effects of hot wet chlorine gases within the cell and high oxygen and ozone concentrations immediately outside the cell.

The apparent rationale of previous chlorine cell cover constructions was that a layer of a chlorine impermeable polymer such as polyisoprene, e.g., natural rubber, was disposed at or near the inner surface of the cover to contact the corrosive chlorine atmosphere within the tank and the outwardly disposed layer of the cover was comprised of a highly ozone-resistant material such as neoprene rubber or ethylene propylene terpolymer rubber. Although the rationale seems logical enough in theory, it is apparently incorrect since under actual conditions, the cell covers as previously described have not withstood the combined effects of the substances within and outside the cells. For example, it has been found that the ozone resistant outer layers have shown as much effects of the chlorine degradation as have the inner layers of the cover and in fact have also shown failures which appear to be ozone cracking. On the other hand, laboratory data indicates that the cell covers should have the capabilities of withstanding high ozone concentrations for almost an indefinite period when material such as ethylene propylene terpolymer are used to form the outer layer of the cover. It has also been determined that the outer neoprene layers have not been sufficiently resistant to heat and high ozone concentrations.

U.S. Pat. No. 3,794,577, issued on Feb. 26, 1974 to B. H. Oliver and H. S. Custer (the latter being one of the present inventors), discloses an improved cell cover provided from blended compositions of single layers or combined laminated layers of heat and ozone resistant fluid impermeable materials. The cover is comprised of a vulcanized blend of polyisoprene resistant to hot wet chlorine gases and other corrosive fluid substances within the cell and butyl, chlorobutyl, bromobutyl rubber or chlorosulfonated polyethylene which resist the permeation or penetration of oxygen and ozone gases from outside the cell. Although these covers have proven satisfactory for long periods of service in chlorine cells, it is desired to produce covers which will perform satisfactorily for even longer periods.

In accordance with the present invention, an improved cell cover having increased resistance to the permeation and penentration of deleterious fluids from both within and without the cell is described hereinafter.

OBJECTS OF THE INVENTION

It is thereore a primary object of the present invention to provide a flexible cell cover for an electrolytic cell capable of withstanding the deleterious substances present both within the cell and outside the cell for longer periods of service.

It is another primary object of the present invention to provide an elastomeric cover for a chlorine cell having improved fluid impermeable properties to resist the penetration by gaseous atmospheres both within and outside of the cell.

Other objects and advantages of this invention will become apparent hereinafter as the description thereof proceeds, the novel features, arrangements and combinations being clearly pointed out in the specification as well as the claims thereunto appended.

In accordance with the present invention, it has been found that the above objects are accomplished in an electrolytic cell for the production of chlorine by providing a flexible elastomeric cover for the cell with the cover having at least one layer comprised of a corrosion resistant elastomeric composition including a vulcanized rubbery polymer to resist deleterious fluids and a multiplicity of small, non-porous, inert particles of a plate-like structure dispersed throughout the polymer to further resist the permeation and penetration of such fluids into the cover. The preponderance of the particles have an aspect ratio (ratio of mean planar diameter to edge thickness) of at least 20:1 and being oriented in a direction generally parallel to a surface of the cover to provide a barrier to the migration into the cover of such deleterious fluids.

Also in accordance with the present invention, the vulcanized rubbery polymer is a polyisoprene selected from the group consisting of natural rubber and synthetic rubber of a cis-1,4 polymer of isoprene. The small particles of plate-like structure or platy fillers is a material selected from the group consisting of graphite, mica, talc, molybdenite, cookeite, stilbite and glass flakes.

The particles preferably are present in an amount of from about 5 to about 50 percent by weight of the elastomeric composition and more preferably from about 15 to about 30 percent thereof.

It is preferred that the particles also predominately have an aspect ratio of at least 100:1. Even more preferably the particles are platy graphite typically having an aspect ratio of predominately at least 147:1.

It is to be understood that for the purposes of this invention, the term "vulcanized" is used in its broadest sense to include all means of cross-linking rubbery polymers both with and without the use of sulfur.

BRIEF DESCRIPTION OF THE DRAWINGS

In the drawings:

FIG. 1 is a schematic cross-section of a typical electrolytic chlorine cell of the mercury type including the cell cover of this invention;

FIG. 2 is a plane view of a chlorine cell cover of ths invention;

FIG. 3 is an enlarged section of a chlorine cell cover taken along the line 3—3 of FIG. 2; and FIGS. 4 and 5 are alternate embodiments of the invention shown in FIG. 3.

FIG. 6 is an enlarged sectional view of another form of the invention similar to that shown in FIG. 3.

DESCRIPTION OF THE PREFERRED EMBODIMENTS

In FIG. 1 a customary electrolytic chlorine cell 10 is shown having graphite anodes 11 and mercury cathodes 12 which are suspended in a brine 13 comprised of a water solution of sodium chloride. In order to provide gaseous chlorine, a high electrical current is passed through line 14 into the anodes in order that a current will pass through the brine. The ionized chlorine will migrate to the anodes 11 and pass through the surface of the brine solution as molecular chlorine. The gaseous chlorine, which contains some water vapor, is thereafter purified and collected.

The cell cover 15 is shown in its uninstalled condition in FIG. 2. The cover 15 is formed of at least one layer of a corrosion resistant elastomeric compound or composition and includes a plurality of holes 16 which preferably are punched through the cover after vulcanization in order that the cell cover may be bolted to the top of cell 10. The composition is of an intermediate or medium hardness having a durometer hardness level of from about 50 to about 75 and preferably from about 60 to about 70 as measured on the Shore A scale.

As illustrated in FIG. 3, in this instance the cover is two laminated or adhered layers 17 and 18. The innermost layer 17 includes a vulcanized rubbery polymer such as polyisoprene which is resistant to the permeation and attack of the chlorine and containing a multiplicity of small, non-porous inert particles 19 dispersed throughout the polymer in the layer 17.

The polymer may be natural rubber or synthetic rubbers of a cis-1,4 polymer of isoprene known as synthesized "natural rubber" which is in contact with the hot wet chlorine gas atmosphere within the cell. The polyisoprene polymer resists the permeation of chlorine and other deleterious gaseous fluid substances within the cell by forming a hard crust on the inwardly facing surface 20 of the layer 17 which retards the progress of the chlorine gases or vapors into the cover 15.

The particles 19 are of plate-like, flake-like or leaf-like structure or form often referred to as platelets. These plate-like particles are introduced as platy fillers in the corrosion resistant elastomeric composition of layer 17 and are oriented or aligned generally parallel to the surface 20. This orientation is effected, due to shear flow, during processing of the cover 15, for example, through calendering and extruding followed by vulcanization in a press, rotocure or autoclave.

The platy particles 19 of the present invention are generally broad and thin possessing a relatively large surface area per unit weight as compared to other particle shapes, such as granular, needle, spherical and the like and are to be distinguished therefrom accordingly. Moreover, the particles 19 are of micron size having a high ratio of mean planar diameter to edge thickness which will be referred to as the "aspect ratio" of the particle 19. The aspect ratio of the particles, in accordance with the teachings of the present invention, is predominately at least 20:1 and more preferably is predominately at least 100:1. Typically the particles 19 have a thickness of from about $\frac{1}{4}$ to about 80 microns and preferably these particles have a typical thickness of from about $\frac{1}{2}$ to about 20 microns.

In this way, the particles provide an obstacle or barrier to the migration or penetration of deleterious fluids into the cover 15, thereby further retarding the attack of the deleterious fluid on gaseous substances known to exist both within and outside the cell 10.

From investigations of previous cover structures, it is apparent that the area of the cover most susceptible to the attack of the deleterious substances within and outside the cell are those locations in contact with the anodes 11 where the anodes extend through the cover 15 and around the periphery of the cover which is bolted or otherwise attached to the flange of the cell 10. These locations of the cover are under the greatest stress during the operation of the cell, particularly when a vacuum is drawn to recover the free chlorine. Also, as shown in FIG. 1, the portions of the cover 15 which are disposed between the anodes 4 and between the anodes and the cell flange tend to hang downwardly or sag after long periods of use. This also causes stresses at these points of connection. Consequently, it is highly desirable that the elastomeric or polymeric material of the cover 15 be of a relatively high modulus with good tension set characteristics. For example, the material of the cover should have a modulus of at least 500 psi (3.45 MPa (Mega newtons/$m^2$)) when elongated 200 percent and tested in accordance with the method prescribed by the American Society for Testing and Materials (ASTM D-412). Typically, tension set should be about 40 percent after heat aging the elastomeric material of the cell for 168 hours at 212° F (100° C). The durometer hardness of the cover is typically about 60 measured on the Shore A scale.

In FIG. 3 the cover 15 is illustrated as including an outwardly facing layer 18 in combination with the inner layer 17 which may be comprised of a heat and ozone resistant material such as polychloroprene (neoprene), halogenated butyl rubber or ethylene propylene terpolymer rubber or blends thereof. Other heat and ozone resistant polymers such as ethylene propylene rubber or chlorosulfonated polyethylene may also be used in the outwardly facing layer 18.

FIG. 4 illustrates that the composite laminated cell cover 21 of the invention may also include other arrangements of elastomeric or polymeric materials. The cover 21 can be comprised of an inner layer 22 of polyisoprene, an intermediate layer 23 of polyisoprene containing a platy filler 24 and an outer layer 25 of an ozone resistant rubber such as chlorinated butyl rubber or a blend of chlorobutyl rubber and ethylene propylene terpolymer rubber. Each layer functions as previously described to resist heat and the permeation of deleterious, gaseous or fluid substances into the cover 21.

In the embodiment of the invention in FIG. 5, the cover 26 is a composite laminate of at least two discernible layers 27 and 28 with the innermost downward facing layer 27 comprised of polyisoprene such as natural rubber or synthesized "natural rubber" and the outermost upward facing layer 28 comprised of an ozone resistant elastomeric composition as previously described with each layer 27 and 28 containing a platy filler such as graphite or flaked glass particles 29. In this case the platy filled polyisoprene layer 27 is in contact with the hot wet chlorine gas atmosphere within the cell and resists the penetration of the chlorine into the cell cover 21. The outer platy filled layer 28 comprised for example of a blend of chlorinated butyl rubber and ethylene propylene terpolymer rubber is heat resistant and also resists the penetration of any chlorine gas that may pass through the inner platy filled polyisoprene layer 27 and also resists the penetration of oxygen and ozone from outside the cell.

Of course, it is apparent that other arrangements of the elastomeric layers are possible with the platy particles being provided in any one or all of the individual layers. For example, as illustrated in FIG. 6, the laminated cover 30 may include an outwardly disposed ozone-resistant layer 31 containing a platy filler 32 and an inwardly disposed layer 33 of polyisoprene rubber which in this case does not contain a platy filler.

The platy material forming the particles 19, 24, 29 and 32 must be dense or non-porous and chemically inert to resist the permeation and penetration of harmful fluid substances into the cover 15.

These particles may be composed of foliate materials such as natural minerals that exfoliate when mechanically pulverized to give plate-like particles or platelets. Examples of such materials are carbon in the form of graphite, various silicates such as mica as described in U.S. Pat. No. 3,764,456, platy talc ($3\ MgO.4SiO_2.H_2O$), molybdenite ($MoS_2$), cookeite ($(HO)_6LiAl_3Si_2O_6$) and stilbite in the form of sodium/calcium or alumina silicates.

In this regard it has been found that graphite typically having a specific gravity of 1.26 and a particle thickness of about ½ micron in which 99% will pass through a 100 mesh screen and 85% will pass through a 200 mesh screen and predominately having an aspect ratio of at least 147:1 is a highly satisfactory platy filler in accordance with the present invention.

In addition non-foliate materials can also be used in the practice of the present invention which can be foliated by special processes. For example, flaked glass produced by the hammer-mill process will provide a highly suitable material. The platy flaked glass particles may have a thickness of about 2 microns and a plate size of 1/16 of an inch (1.59 mm) with a preponderance of the particles having an aspect ratio of at least 794:1. The flaked glass may be Hammer Milled Flaked Glass, Type C, produced by Owens Corning Company.

The elastomeric composition usually includes the plate-like particles in an amount of from about 5 to about 50 percent by weight, it being preferred that the particles are present in an amount from about 15 to about 30 percent of the composition. The platy filler should not be introduced in excessive amounts which will tend to overly reinforce or stiffen the elastomeric composition and detrimentally affect its physical properties.

It is to be understood that the shape and size of the particles are of particular criticality with the exact chemistry of the particle being of only secondary importance. For instance, the use of graphite in the form of chunks or granules or the use of glass spheres, granules or chunks would not accomplish the purpose of the present invention. Therefore an important consideration in the present invention is the use of an inert impervious plate-like filler rather than the use of a particular type of material such as graphite, glass, mica or talc. To illustrate this point even more succinctly, carbon black, even though of the same chemistry as graphite (each composed of carbon) is of such a size and shape as to be totally ineffective to retard the penetration and permeation of chlorine and other such corrosive substances. Therefore, so long as a material will resist hot wet chlorine atmosphere of the cell, its particular chemistry is inmaterial and only its particular physical form is important.

It should be noted that it is old in the art of rubber compounding to use graphite particles of a plate-like structure in "hard rubber" compositions (Durometer hardness of 90 Shore A and above) for use in corrosive atmospheres. Such compositions are used in hard rubber linings for receptacles containing corrosive substances such as acids in which the lining is adhered to the metal shell of the receptacle or tank. In addition, U.S. Pat. No. 3,563,878 at Column 4, lines 44–46 discloses the use of resins which are highly filled with graphite particles as cell liners for diaphragm type electrolytic cells. To Applicants' knowledge, however, graphite particles or other inert materials in the form of platelets have not been used in flexible elastomeric covers of medium hardness in accordance with the present invention.

In the practice of this invention, the polyisoprene polymer is selected from the group consisting of natural rubber and synthetic rubber of a cis-1,4 polymer of isoprene which may contain up to 15 percent of the trans polymer and which are similar to natural rubber in structure and use. The natural rubber than can be used is any of the well-known types such as pale crepe and smoked sheet, SMR (Standardized Malaysian Rubber), chemically treated natural rubber or balata. It has been found that polyisoprene polymers of the type described, when compounded properly, will be resistant, at least to a significant degree, to the permeation and attack of hot chlorine gases and other corrosive compounds present within the interior of a mercury type chlorine cell.

In accordance with the invention, a vulcanized rubbery polymer resistant to heat and high ozone concentrations is at least one polymer selected from the group consisting of polychloroprene rubber, halogenated butyl rubber such as chlorinated butyl rubber and brominated butyl rubber, ethylene propylene terpolymer rubber (EPDM), ethylene propylene rubber and a chlorosulfonated polyethylene or combinations thereof. Even more preferably these polymers are selected from the group consisting of polychloroprene rubber, chlorobutyl rubber and ethylene propylene terpolymer rubber or blends thereof.

Polychloroprene rubbers are polymers of chloroprene having the formula 2 chloro-1,3-butadiene and commonly referred to as neoprene rubbers.

The halogenated butyl rubbers, often referred to as halobutyl rubbers, are well known in the art being prepared normally by the halogenation of butyl rubber. Halobutyl rubbers include chlorobutyl as well as bromobutyl rubber. Descriptions of halobutyl rubber and its preparation appear in U.S. Pat. No. 3,242,148, the revelations of which are incorporated herein by reference. In chlorobutyl rubber, typically the chlorine content is less than 3 percent by weight normally being about 1.1 to about 1.3 weight percent. Normally about 75 percent of the unsaturation in the original butyl rubber is retained on chlorination, the unsaturation usually being from about 1.1 to about 1.7 percent. The compounding and vulcanization of chlorobutyl rubber is well known; see U.S. Pat. No. 3,197,446, the disclosures of which are incorporated herein by reference. Sulfur and accelerator combinations or zinc oxide, zinc chloride, diamines and dithiols are examples of compounds which can be used in the vulcanization of halobutyl rubber. Bromobutyl rubber is similar to chlorobutyl rubber, the main difference being that it contains bromo groups rather than chloro groups. Butyl rubbers containing both chloro and bromo groups can also be used.

Halogenated butyl rubbers are also described in the *Encyclopedia of Chemical Technology,* Second Supplement Volume, edited by Raymond E. Kirk and Donald F. Othmer, The Interscience Encyclopedia, Inc., New York, pages 716 to 734, and the *Encyclopedia of Polymer Science and Technology,* Vol. 2, Interscience Publishers, a division of John Wiley & Sons, Inc, New York, London, Sidney, pages 762, 763, 771, 772 and 782. The revelations of these references are incorporated herein by reference.

The chlorosulfonated polyethylenes which can be used in the present invention are solid polymers and are well known in the art. They possess a chlorine content of 10 percent to 50 percent, preferably 25 to 50 percent, more preferably 25 to 30 percent, and most preferably 28 to 30 percent. They can be prepared by the chlorination of polyethylene and reacting the polymer with sulfur dioxide to introduce sulfonyl chloride groups. These polymers are described in U.S. Pat. Nos. 2,212,786, 2,586,363; 2,646,422; 2,862,917; 2,879,261; 2,972,604 and 2,982,759. The sulfur content of the polymers due to the sulfonyl groups is from 0.40 percent to 3.0 percent, preferably 0.70 percent to 3.0 percent and most preferably 1.0 to 1.5 percent. A typical polymer has a molecular weight of about 20,000; a specific gravity of about 1.11 to 1.28 and a raw polymer viscosity of 30 to 66 (ML-4 at 212° F(100° )).

The ethylene propylene terpolymers which may be used in accordance with the present invention are terpolymers of ethylene, propylene and non-conjugated dienes (EPDM). Representative examples of these rubbery terpolymers are described in U.S. Pat. No. 3,331,793, Column 2, lines 54–59.

The ethylene propylene polymers useful in the practice of the present invention consist essentially of linear homogeneous copolymers of propylene and ethylene as particularly described in U.S. Pat. No. 3,300,459.

Various vulcanizing agents well known in the art may be used to cure or vulcanize the polymers used in the practice of the present invention. Representative examples of the vulcanizing agents are: vulcanizing agents of the peroxide type, such as dicumyl peroxide, or of the nitroso compound type, or sulfur and the sulfur-containing agents such as benzothiazole disulfide, tetramethyl thiuram disulfide, 4,4-dithio-diomorpholine, 4-morpholino-2 benzothiazole disulfide, or diphenyl guanidine. Activators well known in the art such as zinc oxide, magnesium oxide and stearic acid should also be used to enhance the cure where appropriate.

The above-named vulcanizing agents with the exception of the peroxide type are also well known for the vulcanization of halobutyl rubbers such as chlorinated butyl and brominated butyl rubbers.

Any of the well-known vulcanizing agents as named above may be used to cure the polyisoprene compositions of the present invention. The cure may be enhanced by the presence of zinc oxide and stearic acid.

Various additives, fillers, plasticizers and pigments can also be added to the polymers of the present invention. Examples of such materials are: carbon blacks, particularly of the fast extruding furnance and high abrasion furnace types, and plasticizers such as petroleum oils, naturally occurring and synthetic ester oils, and resinous polymers of the naturally occurring and synthetic types.

The method of making the flexible vulcanized elastomeric covers of the present invention which may be used, for example, in an electrolytic cell of the mercury type for the production of chlorine includes compounding the various polymeric formulations as discussed above to form a rubbery vulcanized composition. This can be accomplished by conventional mixing techniques using conventional rubber processing equipment such as a Banbury mixer or mixing mill. Equivalent results are obtained with internal Banbury mixed formulations and mill mixed formulations. Curatives may be added during either a first or second pass in the Banbury mixer or separately on a mixing mill. The platy filler of the invention is incorporated into the rubber composition preferably during the first pass in the Banbury mixer. The rubbery polymeric formulations may be formed into a vulcanized cover in a conventional manner, for example, by using a rubber calender or extruder to form the cover into the desired dimensions and by thereafter vulcanizing or curing the formed cover by means of a curing press, rotocure, autoclave or hot air oven. In fabricating the composite laminates of the invention, various plies of elastomeric material may be fabricated by calendering or extruding one onto the other or may be made separately and laminated together by means of suitable adhesives. Any of the well-known adhesives such as cyclized rubber cements and natural rubber cements or neoprene types, etc., may be used for this purpose. These cements are customarily prepared by dissolving the indicated rubbers in suitable solvents such as solvent naptha; aromatic hydrocarbons such as benzene, toluene, or xylene; or chlorinated solvents such as trichloroethylene or carbon tetrachloride to form the cements. When the laminates are prepared by calendering or extruding the elastomeric plies together, the use of an adhesive is unnecessary. The holes are preferably provided after vulcanization by means of punching or cutting but may also be provided during a molding process if desired. Finally, the cover is formed in the desired dimensions and installed in an electrolytic chlorine cell, for example, of the mercury type.

The following example further illustrates the objects and advantages of this invention.

EXAMPLE 1

A flexible vulcanized elastomeric cover 15 of the type shown in FIGS. 1–3 was manufactured having the following composition:

| Components | Parts by Weight |
|---|---|
| Polyisoprene (1) | 100.00 |
| Graphite Filler (2) | 60.00 |
| Carbon Black | 50.00 |
| Stearic Acid | 1.00 |
| Antioxidant | 1.00 |
| Paraffin Wax | 1.00 |
| Plasticizer | 20.00 |
| Zinc Oxide | 5.00 |
| Vulcanizing Agents | 4.00 |
| Total | 242.00 |

(1) Obtained as Natsyn 400. Sold by The Goodyear Tire & Rubber Company.
(2) Graphite platy particles. 99% through 100 mesh screen, 85% through 200 mesh screen. Sold by Asbuty Graphite Mills, Inc. Typical particle size ½ micron.

In the above compositions the plasticizer used was coumarone-indene resin and the carbon black used was of the general purpose furnance type. The vulcanizing agents used were of the sulfur thiuram sulfenamide type with acceleration.

The above formula is expressed in proportions on the basis of parts by weight based on the weight of the polyisoprene rubber.

The above composition was prepared in the following manner. All the compounding ingredients except the zinc oxide and the vulcanizing agents were added to a Banbury mixer and mixed to produce a non-productive stock. The zinc oxide and vulcanizing agents were then added to the non-productive stock in the Banbury during a second pass mixing procedure.

Samples of the composition were tested to determine physical properties with typical results being presented below in Table I. The samples were compression molded in a vulcanizing press at 305° F (150° C) for the 30 minutes shown.

TABLE I

| Original-Cure at 305° F (150° C) (ASTM D-412) | 30 Min | MPa (Mega newtons/ square meter) |
|---|---|---|
| Ultimate Tensile (psi) | 1750 | 12.0 |
| Elongation (%) | 390 | |
| Modulus 100% Elongation (psi) | 914 | 6.3 |
| Durometer Hardness (Shore A)* | 65 | |

The above data contained in Table I illustrates that the heat-resistant platy filled composition has acceptable physical properties for use in a flexible cover for an electrolytic cell.

The above composition was processed on a conventional rubber calender and formed into rectangular sheets or webs of material having a gauge or thickness of ⅛ of an inch (3.18 mm). A 1/16 of an inch (1.59 mm) layer of an ozone resistant vulcanizable rubbery polymer, as described previously, was laminated to the above composition. The laminate had a width of 49 inches (1.24 m) and a thickness of 3/16 of an inch (4.76 mm). The sheets were joined or spliced into 98 inch (2.49 m) widths on a mandrel and vulcanized in an autoclave for 60 minutes at a temperature of 305° (150° C). The vulcanized sheet was trimmed to 91 inches (2.35 m) wide with a length of 16½ feet (5.03 m). Three such sheets or covers were produced.

After vulcanization, the three covers were prepared for installation in an electrolytic cell 10 of the type shown in FIG. 1 by being cut and trimmed to size. The cover 5 had a final width after trimming of 91 inches (2.35 m), a length of 16½ feet (5.03 m) and a gauge of 3/16 of an inch (4.76 mm). Holes 16 were provided in the covers for insertion of the anodes 11.

The covers were installed in electrolytic cells 10 as shown in FIG. 1 of the type described in U.S. Pat. No. 2,958,635 (DeNora type). After approximately 24 months of service the covers functioned properly.

In the practice of the present invention, the example can be repeated by substituting platy fillers of the type described such as glass flakes in place of platy graphite with equivalent results being attained.

While certain representative embodiments and details have been shown for the purpose of illustrating the invention, it will be apparent to those skilled in the art that various changes and modifications may be made therein without departing from the spirit or scope of the invention.

What is claimed is:

1. In an electrolytic cell for the production of halides, a flexible elastomeric cover for said cell, said cover having at least one layer comprised of a corrosion resistant elastomeric composition including a vulcanized rubbery polymer to resist deleterious fluids and a multiplicity of small, non-porous, inert particles of a plate-like structure dispersed throughout said polymer to further resist the permeation and penetration of such deleterious fluids into the cover with the preponderance of said particles having an aspect ratio of at least 20:1 and being oriented in a direction generally parallel to a surface of the cover to provide a barrier to the migration of such deleterious fluids.

2. The invention as claimed in claim 1 wherein said elastomeric composition is of medium hardness having a durometer hardness level of from about 50 to about 75 as measured on the Shore A scale.

3. The invention as claimed in claim 1 wherein said layer is the innermost layer of the cover and said rubbery polymer is resistant to hot wet chlorine gases originating within the cell.

4. The invention as claimed in claim 1 wherein said cover further includes a second layer superimposed over and adhered to the first mentioned layer, said second layer comprised of a rubbery polymer resistant to heat and high ozone concentrations originating outside the cell.

5. The invention as claimed in claim 1 wherein said particles have a typical thickness of from about ¼ to about 80 microns.

6. The invention as claimed in claim 1 wherein said particles are present in an amount of from about 5 to about 50 percent by weight of the elastomeric composition.

7. The invention as claimed in claim 1 wherein said particles are materials of a plate-like structure selected from the group consisting of graphite, mica, talc, molybdenite, cookeite, stilbite and glass flakes.

8. The invention as claimed in claim 1 wherein said particles predominately have an aspect ratio of at least 100:1.

9. The invention as claimed in claim 3 wherein said polymer is a polyisoprene selected from the group consisting of natural rubber and synthetic rubber of a cis-1,4 polymer of isoprene.

10. The invention as claimed in claim 4 wherein the first mentioned layer is an intermediate layer of the cover.

11. The invention as claimed in claim 4 wherein the rubbery polymer of said second layer is selected from the group consisting of polychloroprene rubber, chlorinated butyl rubber, bromobutyl rubber, etheylene propylene rubber and ethylene propylene terpolymer rubber or combination thereof.

12. The invention as claimed in claim 6 wherein said particles are present in the amount of from about 15 to about 30 percent by weight of the elastomeric composition.

13. The invention as claimed in claim 7 wherein said particles are graphite having a typical aspect ratio of at least 147:1.

14. The invention as claimed in claim 1 wherein said layer is the outermost layer of the cover and said rubbery polymer is resistant to heat and high ozone concentrations originating outside the cell.

15. In an electrolytic chlorine cell of the mercury type comprising in combination a container suitable for containing a brine solution, anodes and cathodes positioned to contact the brine solution and through which a sufficient electrical potential may be applied to electrolyze the brine solution, thereby forming chlorine gas at the anodes, said anodes being supported outside said container and extending therein, a flexible fluid tight cover sealing the top of the cell through which the anodes extend, said cover having at least one layer comprised of a corrosion resistant elastomeric compound of intermediate hardness including a vulcanized rubbery polymer resistant to the hot wet chlorine atmosphere originating within the cell, the improvement wherein said compound includes 5 to 50 percent by weight of a filler of dense, inert, platy particles of micron size to further resist the permeation and penetration of chlorine gases into the cover, the preponderance of said platy particles having an aspect ratio of at least 20:1 and being aligned in a direction generally parallel to a surface of the cover to provide a barrier to the migration of chlorine gases into the cover.

16. The invention as claimed in claim 15 wherein said elastomeric compound has a durometer hardness of from about 60 to about 70 as measured on the Shore A scale.

17. The invention as claimed in claim 15 wherein said layer is the innermost layer of the cell and said polymer is a polyisoprene selected from the group consisting of natural rubber and synthetic rubber of a cis-1,4 polymer isoprene.

18. The invention as claimed in claim 15 wherein said cover includes a second layer superimposed and integral with said first mentioned layer, said second layer comprised of a rubbery polymer resistant to heat and high ozone concentrations originating outside the cell, said second polymer selected from the group consisting of chloroprene rubber, chlorinated butyl rubber, and ethylene propylene terpolymer rubber or blends thereof.

19. The invention as claimed in claim 15 wherein said particles are present in an amount of from about 15 to about 30 percent by weight of the elastomeric compound.

20. The invention as claimed in claim 15 wherein said particles are platy graphite having a predominate aspect ratio of at least 147:1.

21. The invention as claimed in claim 15 wherein said particles have a typical thickness of from about ½ to about 20 microns.

22. The invention as claimed in claim 18 wherein the rubbery polymer of said second layer includes 5 to 50 percent by weight of said filler.

* * * * *

UNITED STATES PATENT AND TRADEMARK OFFICE

CERTIFICATE OF CORRECTION

PATENT NO. : 4,087,343

DATED : May 2, 1978

INVENTOR(S) : H S Custer, R C Schisler

It is certified that error appears in the above-identified patent and that said Letters Patent are hereby corrected as shown below:

Column 9, line 54 under "30 Min", "1750" should be -- 1740 --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*